United States Patent [19]

Karol et al.

[11] Patent Number: 4,647,389

[45] Date of Patent: Mar. 3, 1987

[54] ANTI-FRICTION ADDITIVES FOR LUBRICATING OILS

[75] Inventors: Thomas J. Karol, Norwalk, Conn.; Harold S. Magaha, Saint Peters, Mo.; Raymond C. Schlicht, Fishkill, N.Y.

[73] Assignee: Texaco Inc., White Plains, N.Y.

[21] Appl. No.: 766,469

[22] Filed: Aug. 19, 1985

[51] Int. Cl.[4] ..... C10M 129/00

[52] U.S. Cl. ..... 252/51.5 A; 252/34; 564/170; 564/176; 564/177

[58] Field of Search ..... 252/51.5 A, 34; 564/170, 176, 177

[56] References Cited

U.S. PATENT DOCUMENTS 3,997,469 12/1976 Howle ..... 252/51.5 A 4,512,903 4/1985 Schlicht et al. ..... 252/51.5 A

*Primary Examiner*—William R. Dixon, Jr.

*Assistant Examiner*—Margaret B. Medley

*Attorney, Agent, or Firm*—Robert A. Kulason; James J. O'Loughlin; Vincent A. Mallare

[57] ABSTRACT

A lubricating oil composition containing a product prepared by reacting a natural oil with a ($C_2$–$C_{10}$) hydroxy acid and a polyamine whereby the lubricating oil is improved in anti-friction and other properties.

17 Claims, No Drawings

ANTI-FRICTION ADDITIVES FOR LUBRICATING OILS

FIELD OF THE INVENTION

This invention relates to lubricating oils. More particularly, it relates to lubricating oil compositions containing an additive which imparts improvement in anti-friction and other lubrication properties.

BACKGROUND OF THE INVENTION

Generally, it is known that lubricating oil compositions contain a wide range of additives including those which possess anti-wear properties, anti-friction properties, anti-oxidant properties, and the like. Those skilled in the art of lubricating oil additives are continuously seeking additives which may improve these properties without detrimental effect on other properties and which are inexpensive.

Thus, it is an object of this invention to provide a lubricating oil composition containing a novel additive which will improve and enhance its anti-friction properties.

For use as additives in lubricating oil compositions, the additive will have to be soluble and/or stabily dispersable is such oil compositions. By the term oil-soluble it is meant that the subject compositions are soluble to an extent which permits the formed solution to exhibit one or more of the desired properties; e.g., anti-friction and anti-wear. By the term stabily dispersable, the compositions are capable of being suspended in the lubricating oil composition in an amount sufficient to allow the oil to possess one or more of the desired properties imparted to it by the suspended composition. The suspension of the composition can be achieved in various conventional ways such as by physical agitation and by the use of conventional dispersants.

SUMMARY OF THE INVENTION

This invention provides an anti-friction additive for a lubricating oil. The lubricating oil composition comprises (i) a major portion of a lubricating oil; and (ii) a minor effective portion of, as an additive, a product prepared by reacting a natural oil with a ($C_2$–$C_{10}$) hydroxy acid and a polyamine.

The additive product may be represented by Formula I

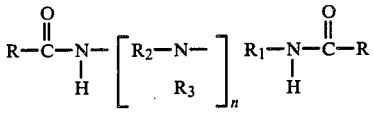

(I)

where R is a ($C_7$–$C_{29}$) alkyl group; $R_1$ is a ($C_1$–$C_{10}$) alkylene group; $R_2$ is a ($C_1$–$C_{10}$) alkylene group which is not necessarily the same in each repeating bivalent radical; $R_3$ is a ($C_2$–$C_{10}$) hydroxy acyl group having (1–9) hydroxyl groups, and/or the

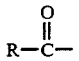

radical, and/or hydrogen with at least one $R_3$ group being a ($C_2$–$C_{10}$) hydroxy acyl group or hydrogen in the repeating bivalent radicals; and n is an integer of 1 to 6.

DESCRIPTION OF THE INVENTION

The lubricating oil additive which may be employed in the practice of this invention may have the formula I

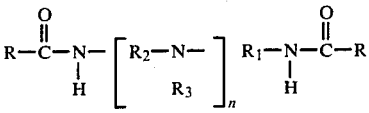

(I)

where R is a ($C_7$–$C_{29}$) alkyl group; $R_1$ is a ($C_1$–$C_{10}$) alkylene group; $R_2$ is a ($C_1$–$C_{10}$) alkylene group which is not necessarily the same in each repeating bivalent radical; $R_3$ is a ($C_2$–$C_{10}$) hydroxy acyl group having (1–9) hydroxyl groups, and/or the

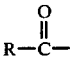

radical, and/or hydrogen with at least one $R_3$ group being a ($C_2$–$C_{10}$) hydroxy acyl group or hydrogen in the repeating bivalent radicals; and n is an integer of 1 to 6.

The fatty acid moiety may be characterized by the formula RCO—.

Typical fatty acids may include those listed below in Table I.

TABLE I

Caprylic
Capric
Lauric
Myristic
Palmitic
Stearic
Oleic
Linoleic etc.

The preferred fatty acid is lauric acid.

In the above fatty acid compound, R may be a hydrocarbon group selected from the group consisting of alkyl, alkenyl, and alkynyl. When R is alkyl, it may typically be octyl, decyl, octadecyl, etc. The preferred R groups may be a $C_8$–$C_{30}$ alkyl, more preferably a $C_{10}$–$C_{20}$ alkyl, and most preferably a $C_{12}$ alkyl group.

It is a feature of this invention that the fatty acid moiety may be derived from various commercially available fats and natural oils typified by those set forth below in Table II.

TABLE II

Coconut
Babassu
Palm kernel
Palm
Olive
Castor
Peanut
Rape
Beef Tallow
Lard (leaf)
Whale blubber
etc.

The preferred natural oil is coconut oil which typically contains residues listed below in Table III.

TABLE III

| Component | Wt. % |
|---|---|
| Caprylic | 8.0 |
| Capric | 7.0 |
| Lauric | 48.0 |
| Myristic | 17.5 |
| Palmitic | 8.2 |
| Stearic | 2.0 |
| Oleic | 6.0 |
| Linoleic | 2.5 |

The $C_2$–$C_{10}$ hydroxy acids used in the present preparation may include glycolic acid, lactic acid, hydracrylic acid, dihydroxyacids such as glyceric acid and poly hydroxyacids such as tri-(hydroxymethyl)acetic acid. The preferred acids are those having from 1 to 4 carbon atoms.

The polyamine which may be used according to the present invention is selected from the group including diethylenetriamine (DETA), triethylenetetramine (TETA), tetraethylenepentamine (TEPA), N,N'-bis-(3-aminopropyl)ethylene diamine (BAPEDA), and bis-(1,3-propylene)triamine.

In preparing the additives which are anti-friction additives for a lubricant, the reaction involves the interaction in between a natural oil such as coconut oil, a ($C_2$–$C_{10}$) hydroxy acid such as glycolic acid and a polyamine such as diethylenetriamine (DETA). In the reaction, the reactants are provided in a molar ratio of natural oil to polyamine ranging from about 2:1 to about 10:1, and a molar ratio of hydroxy acid to polyamine ranging from about 0:1 to about 6:1.

According to this invention, the additives may be added to a major portion of a hydrocarbon lubricating oil as a minor effective portion of preferably from about 0.05 to about 10.0 wt.%, and more preferably from about 0.20 to about 1.0 wt.%.

In another embodiment of this invention, the anti-friction additive may be prepared by the reaction of a natural oil, such as coconut oil and a polyamine, such as diethylenetriamine, which produces a product having the formula II

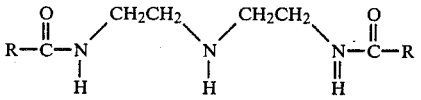

(II)

where R is a ($C_7$–$C_{29}$) straight chain alkyl group of a fatty acid.

According to the present invention, the natural oils listed in Table II above as well as amines such as DETA, TETA, TEPA, BAPEDA, and bis-(1,3 propylene) triamine may be used in the preparation of the additive represented above by formula II. Also, the reactants are reacted under the same conditions and in the same molar ratios as used in preparing the additives represented by formula I.

The hydroxyacylated fatty acid amides of a polyamine can be combined with derivatives to form a variety of concentrates with the deliverants being substantially inert. When the solvent, the diluent or the like is added to the compound of the subject invention, the properties of the same are not materially interfered with in such areas as compound preparation, storage, blending, and/or functioning in the context of its intended use.

The compositions of the subject invention can be employed in a variety of lubricants based on diverse oils of lubricating viscosity, including natural and synthetic lubricating oils and mixtures thereof. These lubricants include crankcase lubricating oil for spark-ignited and compression-ignited internal combustion engines, including automobile and truck engines; two cylinder engines; aviation piston engines; marine and railroad diesel engines, and the like. They can also be used in gas engines, stationary power engines, and turbines and the like. Automatic transmission fluids, transaxle fluids, lubricant metal working lubricants, hydraulic fluids, and other lubricating oil and grease compositions can also benefit from the incorporation therein of the composition of the present invention.

Without being bound to one theory of how these hydroxyacylated fatty acid amides of polyamines, and their compositions function as friction modifiers in lubricating oil composition, it has been theoretically proposed that the outstanding performances of the compound is the result of a strong bond formed between the subject compound and the metal ions and the metal surfaces contacting with the lubricating oil composition.

The polar part of the composition is adsorbed onto the metal surface to form a strongly bonded layer. The fatty alkyl groups attached to the lower polar portion of the composition extend out from the surface. When the metal parts are in motion, the fatty alkyl groups reduce the degree of contact between the asperities of the parts, therefore, friction is correspondingly reduced. The metal parts are worn out less rapidly than if the hydroxyacylated fatty acid amide was not present in a contacting lubricating oil composition. Equally, as important, a fuel savings is realized and less fuel is required in any given circumstance as the amount of energy expended in overcoming frictional resistance is lessened.

The lubricating oils which may be employed in the practice of the process of this invention may include a wide variety of hydrocarbon or synthetic lubricating oils used for example in automotive, aircraft, railroad, diesel, marine, tractor lubricating service for heavy duty or light duty, for winter or summer operations.

It is a feature of this invention that lubricating compositions containing effective amounts of the present additives may be characterized by anti-wear and anti-friction properties. The low cost of the additives makes it possible in many instances to attain results comparable to prior art commercial friction modifiers but at a lower cost.

The anti-wear properties of lubricating compositions containing the additives of this invention may show improved results when tested by the Four Ball Wear Test described below.

THE FOUR BALL WEAR TEST

The Four Ball Wear Test is carried out by securely clamping three highly polished steel balls (each 0.5 inch in diameter) in a test cup in an equilateral triangle in a horizontal plane. The fourth highly polished steel ball, resting on the three lower balls to form a tetrahedron, is held in a chuck. A weight lever arm system applies weight to the test cup, and this load holds the balls together. In the standard test, the speed of rotation is 1800 rpm; the load is 40 kilograms. The assembly is submerged in the liquid to be tested. The test is carried out at 200° F. for 60 minutes. As the chuck and upper ball rotate against the fixed lower balls, the friction of the upper ball rotating in relation to the lower balls produces a wear-scar the diameter of which (i.e. the depth along a diameter of the ball) is measured. The average of the wear on the three lower balls is the rating assigned (in millimeters).

The anti-friction properties of the additives of this invention may be equal to the "good reference" when tested in the Small Engine Friction Test (SEFT) described below.

SMALL ENGINE FRICTION TEST

The Small Engine Friction Test (SEFT) uses a single cylinder, air-cooled, 6-horsepower engine driven by an electric motor. The engine has a cast-iron block and is fitted with an aluminum piston and chrome-plated rings. The electric motor is cradle-mounted so that the reaction torque can be measured by a strain arm. The engine is housed in a thermally insulated enclosure with an electric heater and is driven at 2000 rpm.

Prior to each test, the engine is flushed three times with 1-quart changes of test oil. During the test run, the engine and oil temperatures are increased continually from ambient until a 280° F. oil temperature is reached. The heat comes from engine friction, air compression work and from the electric heater. The engine and oil temperatures and the engine motoring torque are recorded continually during the test. A SEFT run takes about 4 hours. Each test oil evaluation is preceded by a run on a reference oil for a like period of time. The torque reference level for the engine shifts very slowly with time as a result of engine wear. Therefore, the test oil results are recorded compared to a reference band consisting of data from up to three reference runs made before and three runs made after the test oil evaluation.

In another aspect of the present invention, it has been found that the present anti-friction additives also impart a dispersancy property to lubricating oil compositions.

For example, in both Bench VC and VD tests, the present additives were evaluated for their dispersancy properties in 10W-40 motor oil formulations. In these tests, both the coconut oil and DETA reaction product and that of its glycolic acid amide derivative were as effective as conventional polyisobutenyl-succinimides, despite their much lower molecular weights.

On the basis of these bench tests, both types of the present additives appear to be effective dispersants in gasoline engines, reducing sludge and piston varnish.

DESCRIPTION OF PREFERRED EMBODIMENTS

Practice of the process of this invention will be apparent to those skilled in the art from the following Examples, wherein, as elsewhere in this specification, all parts are part by weight unless otherwise noted.

EXAMPLE I

In this example which represents the best mode known to practicing the process of this invention, the following reactants were employed:

| Reactant | grams | moles |
|---|---|---|
| Coconut Oil | 164 | 0.25 |
| Diethylenetriamine | 34.8 | 0.338 |
| Glycolic Acid, 70% Aq. Solution | 37 | 0.35 |
| Diluent Oil - 100 E Pale Stock HF | 218 | — |

The reactants were charged and were blanketed with nitrogen. The reaction was heated to 160° C. removing water as it was formed and maintained at 160° C. for 8 hours. The product was filtered hot.

The product had a TBN of 15.5 and contained 3.21 nitrogen.

The results of the small engine friction test of the product in a base blend at an active concentration of 0.5 wt.% are shown below in Table IV. In this test, there were six (6) runs made at various temperatures for both a lubricating oil not containing an additive and that same lubricating oil containing an additive, i.e., the product described above. The results show the high torque (1) and low torque (2) for each run of lubricating oil not containing a friction reducing additive, the torque (3) of the lubricating oil containing a test additive and the torque reduction (4) effected by the test additive in each run. As shown in the critical temperature range of 220° F.–280° F., the test additive effected the greatest reduction of torque i.e., reduction in loss of energy due to friction. That is, the additive caused a reduction in loss of energy due to friction of more than 10 percent.

TABLE IV

| SMALL ENGINE FRICTION TEST Torque (Ft - Lbs) | | | | | | |
|---|---|---|---|---|---|---|
| Run | 1 | 2 | 3 | 4 | 5 | 6 |
| Temperature (°F.) | 130 | 160 | 190 | 220 | 250 | 280 |
| No Additive - High (1) | 3.15 | 3.15 | 3.15 | 3.20 | 3.24 | 3.34 |
| No Additive - Low (2) | 3.15 | 2.92 | 2.92 | 3.16 | 3.22 | 3.29 |
| No Additive - Avg. | 3.15 | 3.04 | 3.04 | 3.18 | 3.23 | 3.32 |
| Additive (3) | 3.18 | 2.92 | 2.88 | 2.88 | 2.88 | 2.95 |
| Torque Reduction (4) | −0.03 | 0.12 | 0.16 | 0.30 | 0.35 | 0.37 |

(1) Highest torque exhibited of lubricating oil containing no friction reducing additive.
(2) Lowest torque exhibited of lubricating oil containing no friction reducing additive.
(3) Torque exhibited by test additive containing lubricating oil.
(4) Torque reduction provided by test additive in lubricating oil.

EXAMPLE II

In the example, the following reactants were employed:

| Reactant | grams | moles |
|---|---|---|
| Coconut Oil | 164 | 0.25 |
| Diethylenetriamine | 34.8 | 0.338 |
| Diluent Oil - 100 E Pale Stock HF | 199 | |

The reactants were charged and blanketed with nitrogen and the reaction was heated to about 130° C. and maintained for 3 hours. The product was filtered hot.

The product contained 3.47% nitrogen.

The results of the small engine test of the product in a base blend at an active concentration of 0.5 wt.% are shown below in Table V. In this test, there were six (6) runs made at various temperatures for both a lubricating oil not containing an additive and that same lubricating oil containing an additive, i.e., the product described above. The results show the high torque (1) and low torque (2) for each run of lubricating oil not containing a friction reducing additive, the torque (3) of the lubricating oil containing a test additive and the torque reduction (4) effected by the test additive in each run. As shown in Table IV, in the critical temperature range of 220° F.–280° F., the test additive effected the greatest reduction of torque i.e., reduction in loss of energy due to friction. That is, the additive caused a reduction in loss of energy due to friction of more than 12.0 percent.

TABLE V

SMALL ENGINE FRICTION TEST
Torque (Ft - Lbs)

| Run | 1 | 2 | 3 | 4 | 5 | 6 |
|---|---|---|---|---|---|---|
| Temperature (°F.) | 130 | 160 | 190 | 220 | 250 | 280 |
| No Additive - High (1) | 3.1 | 3.01 | 3.01 | 3.20 | 3.24 | 3.30 |
| No Additive - Low (2) | 3.1 | 2.95 | 2.95 | 3.11 | 3.20 | 3.26 |
| No Additive - Avg. | 3.1 | 2.98 | 2.98 | 3.15 | 3.22 | 3.28 |
| Additive (3) | 3.1 | 2.90 | 2.85 | 2.85 | 2.87 | 2.88 |
| Torque Reduction (4) | 0.0 | 0.08 | 0.13 | 0.30 | 0.35 | 0.40 |

(1) Highest torque exhibited of lubricating oil containing no friction reducing additive.
(2) Lowest torque exhibited of lubricating oil containing no friction reducing additive.
(3) Torque exhibited by test additive containing lubricating oil.
(4) Torque reduction provided by test additive in lubricating oil.

We claim:

1. A lubricating oil composition comprising (i) a major portion of lubricant oil; and (ii) from about 0.05 to about 10.0 wt.% of, as an additive, a product prepared by reacting a natural oil selected from the group consisting of coconut, babassu, palm, palm kernel, olive, castor, peanut, beef tallow and lard, with a ($C_2$–$C_{10}$) hydroxy acid and a polyamine.

2. The lubricating oil composition of claim 1, wherein the product is

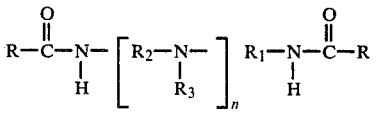

(I)

where R is a ($C_7$–$C_{29}$) alkyl group; $R_1$ is a ($C_1$–$C_{10}$) alkylene group; $R_2$ is a ($C_1$–$C_{10}$) alkylene group which is not necessarily the same in each repeating bivalent radical; $R_3$ is a ($C_2$–$C_{10}$) hydroxy acyl group having (1–9) hydroxyl groups, and/or the

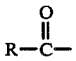

radical, and/or hydrogen with at least one $R_3$ group being a ($C_2$–$C_{10}$) hydroxy acyl group or hydrogen in the repeating bivalent radicals; and n is an integer of 1 to 6.

3. The lubricating oil composition of claim 1, wherein said natural oil is coconut.

4. The lubricating oil composition of claim 1, wherein said hydroxy acid is selected from the group consisting of glycolic acid, lactic acid, hydracrylic acid, glyceric acid, and tri-hydroxymethylacetic acid.

5. The lubricating oil composition of claim 4, wherein said hydroxy acid is glycolic acid.

6. The lubricating oil composition of claim 1, wherein said polyamine is selected from the group consisting of diethylenetriamine, N,N'-bis-(3-aminopropyl)ethylenediamine, triethylenetetramine, tetraethylenepentamine and bis-(1,3 propylene) triamine.

7. The lubricating oil composition of claim 6, wherein said polyamine is diethylenetriamine.

8. The lubricating oil composition of claim 1, wherein the natural oil is reacted with said polyamine in a molar ratio ranging from about 2:1 to about 10:1.

9. The lubricating oil composition of claim 1, wherein the hydroxy acid is reacted with said polyamine in a molar ratio ranging from about 0:1 to about 6:1.

10. The lubricating oil composition of claim 1, wherein the minor effective portion of said product ranges from about 0.2 to about 1.0 wt.%.

11. A lubricating oil composition comprising (i) a major portion of a lubricant, and (ii) from about 0.05 to about 10.0 wt.% of, as an additive, a product prepared by reacting a natural oil selected from the group consisting of coconut, babassu, palm, palm kernel, olive, castor, peanut, beef tallow, and lard, with a polyamine.

12. The lubricating oil composition of claim 11, wherein the product is

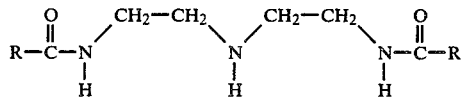

where R is a ($C_7$–$C_{29}$) straight chain alkyl group of a fatty acid.

13. The lubricating oil composition of claim 11, wherein said natural oil is coconut.

14. The lubricating oil composition of claim 11, wherein said polyamine is selected from the group consisting of diethylenetriamine, N,N'-bis-(3-aminopropyl-)ethylenediamine, triethylenetetramine, tetraethylenepentamine and bis-(1,3 propylene) triamine.

15. The lubricating oil composition of claim 11, wherein said polyamine is diethylenetriamine.

16. The lubricating oil coposition of claim 11, wherein the natural oil is reacted with said polyamine in a molar ratio ranging from about 2:1 to about 10:1.

17. The lubricating oil composition of claim 11, wherein the minor effective portion of said product ranges from about 0.2 to about 1.0 wt.%.

* * * * *